US005636705A

United States Patent [19]

St-Germain

[11] Patent Number: 5,636,705

[45] Date of Patent: Jun. 10, 1997

[54] APPARATUS FOR MOVING A WORK PLATFORM ALONG A RAIL

[76] Inventor: André St-Germain, 1346, Rang du Bassin, Saint-Bonaventure, Québec, Canada, J0C 1C0

[21] Appl. No.: 447,860

[22] Filed: May 24, 1995

[51] Int. Cl.[6] ..... E04G 1/18

[52] U.S. Cl. ..... 182/141; 182/148; 74/89.15; 74/424.6; 254/7 R; 254/103

[58] Field of Search ..... 182/141, 145, 182/146, 148; 74/89.15, 424.6, 459, 465; 187/268; 254/7 R, 7 C, 89 R, 103

[56] References Cited

U.S. PATENT DOCUMENTS

| | | | |
|---|---|---|---|
| 4,541,297 | 9/1985 | Fujita | 74/424.6 |
| 4,600,085 | 7/1986 | Gagnon et al. | 187/268 |
| 4,809,814 | 3/1989 | St-Germain | 182/146 |
| 4,919,236 | 4/1990 | Karlsson et al. | 187/268 |
| 5,186,067 | 2/1993 | Demissy | 74/424.6 |
| 5,271,482 | 12/1993 | Walz | 182/148 X |

FOREIGN PATENT DOCUMENTS

| | | | |
|---|---|---|---|
| 716930 | 10/1966 | Italy | 182/141 |
| 9212091 | 7/1992 | WIPO | 182/141 |

*Primary Examiner*—Peter M. Cuomo
*Assistant Examiner*—James O. Hansen
*Attorney, Agent, or Firm*—François Martineau

[57] ABSTRACT

The scaffolding comprises a post having a plurality of vertically aligned and equally spaced studs protruding on one of its surfaces. A frame supporting a work platform can move along the post, a sleeve being attached to the frame for guiding it along the post. The sleeve, the frame and the work platform partially surround the post. A lifting apparatus, installed on the sleeve, comprises a rotatable endless screw which is parallel to the post and which has a peripheral and helical flange which bears on the studs. An engine, an electric power drill or a manual handle will rotate the endless screw via one or two speed reducers. The rotation movement of the endless screw will result in the axial displacement thereof along the post, carrying the frame and work platform along with it. Another embodiment of the invention comprises a work platform which is supported at both of its ends by a lifting apparatus movable along a post. If two or more work platforms work at a given time, two work platforms may share a same post between the two of them and nonetheless work independently. The rail is also equipped with protruding aligned and equally spaced studs on which an endless screw bears for axial displacement of the latter resulting from its rotation movement along the rail. The endless screw is parallel to the rail.

11 Claims, 11 Drawing Sheets

APPARATUS FOR MOVING A WORK PLATFORM ALONG A RAIL

FIELD OF THE INVENTION

The present invention relates to a self-erecting scaffolding, more particularly to a lifting apparatus for such a scaffolding.

BACKGROUND OF THE INVENTION

Many conventional scaffoldings, such as the ones described in the U.S. Pat. No. 4,809,814 delivered in 1989 to Jean ST-GERMAIN (hereafter the '814 patent) and in the U.S. Pat. No. 3,318,414 delivered in 1967 to MEEK (hereater the MEEK patent), comprise one or more towers along which corresponding sleeve members are movable. The sleeve members can either slide along the towers (as in the MEEK patent) or they can be equipped with a plurality of idle wheels rotatably attached thereto and roll along the towers (as in the '814 patent). Each sleeve member supports a work platform allowing the workers an even surface to stand on while they accomplish their tasks. The sleeve members (and consequently the work platforms) can be raised or lowered at a desired height.

To raise or lower a platform along a tower, a few systems have been introduced in the prior art.

A very common system is the use of a rack and gear assembly. The tower is equipped with a vertical elongated rack which has equally spaced teeth that are complementary to those of a gear wheel. The shaft of the gear wheel is installed on the sleeve member supporting the work platform and is linked to power means (either manual, electrical or other). When the power means are activated, the gear wheel will engage the rack to raise (or lower) the platform.

A first problem with this system is that the whole load of the work platform and its contents is supported by a single (or possibly two) tooth of the gear wheel which bears on a corresponding rack tooth at a given time. This is indesirable, since the load bearing on the tooth can be rather significant (1000 pounds or more). It is thus possible that a rack or a gear wheel tooth will break under the load, since the surface of said tooth is relatively small for supporting such a load.

Another problem associated with this system is that the gear wheel shaft itself will occasionally break under the torque induced by the carried load. This is partially due to a too small reducing gear ratio: for example, while a 5:1 ratio may be good under most circumstances, the wear of the system and/or an especially heavy load may induce constraints that are greater than what is allowable in the system, resulting in the breaking of the shaft.

Yet another problem with the above-mentioned system is that the rack and gear assembly requires a good deal of grease for lubrification of the rack and gear wheel connection, because of the high friction resulting therefrom. This grease may be undesirable in certain specific circumstances, especially when a clean or sterile environment is needed.

Another problem with the rack and gear assembly arises when dealing with cement or another similar material. Indeed, during the cementing process, the cement will often embed itself in the grooves between two sucessive rack teeth, to be compacted there by the gear wheel teeth as they lodge themselves in these grooves while the wheel rolls along the rack. The gear wheel will consequently have less or no surface to bear upon since the space between two rack teeth will be at least partially filled with cement. A lifting aparatus thus impaired can no longer be used until it is cleansed of the cement, which can be a strenuous task if the cement is dry.

The prior art shows other systems to raise a work platform, notably the two previously-mentioned patents.

The MEEK patent shows a pulley 37 from which depends the two extremities of a cable 41. A winch and drum mechanism can be activated by means of a winch handle 42 to raise or lower the platform manually by rolling up cable 41, cable 41 being attached to the platform.

The '814 patent shows a platform raising system (FIG. 7) comprising an arm 84 and a ram member 106 that work together to raise (or lower) the platform 42. Ram member 106 will alternately extract and retract its piston rod 112 which will correspondingly raise and lower its hook member 118. The latter will engage successive steps or rungs 38 to raise work platform 42. While hook member 118 is being raised, arm 84 (and safety arm 84') pivotably engages a rung 38 to sustain work platform 42.

Several alternatives have been used in other inventions, but they remain substantially similar to one or the other of the above-mentioned systems.

OBJECTS OF THE INVENTION

It is an object of this invention to provide an apparatus for moving a work platform along a rail.

Another object of this invention is to provide a lifting system for lifting a work platform that will support the load with more than one point of contact.

It is another object of this invention that the speed reducing ratio of the lifting system be important enough to prevent the breakage of the driving wheel shaft.

Another object of this invention is that the lifting apparatus of the invention be functional without the need of a lubrification agent.

Yet another object of this invention is that the lifting apparatus is not liable to be clogged by any cement or similar material that would hamper its operation.

SUMMARY OF THE INVENTION

The present invention is a moving apparatus for moving a work platform along a rail member, comprising a plurality of aligned, equally spaced stud members laterally protruding from said rail member, a sleeve member which at least partially surrounds said rail member for longitudinal movement therealong and to which is attached said work platform, an endless screw rotatably attached to said sleeve member for rotation about an axis parallel to the longitudinal axis of said rail member, said endless screw defining a peripheral helical flange, and power means for inducing a rotation movement to said endless screw, said peripheral flange bearing on at least two of said stud members for axial movement of said endless screw resulting from the rotation movement thereof.

Alternately, said rail member can be a post member and said moving apparatus, a lifting apparatus, for raising said work platform along said post member.

Preferably, said helical flange of said endless screw bears on three of said stud members.

Advantageously, said stud members include aspheric ball bearings allowing an angular axial play of each of said ball bearings, said play allowing said ball bearing to set itself under the load of said endless screw so that the peripheral surface of said ball bearing will support said endless screw with its whole width.

Preferably, said power means and said endless screw are linked through the instrumentality of at least one speed reducer which will impart slower speeds to said endless screw but will allow said moving apparatus to move greater loads for a same power output.

Advantageously, said power means is a reversible electric motor.

Alternately, said power means is a manual driving handle for imparting rotation movement to said endless screw.

Preferably, said sleeve member has a plurality of pairs of idle wheels rotatably mounted thereon, said idle wheels bearing on said rail member and guiding said sleeve member therealong.

Advantageously, said moving apparatus further comprises a security brake member for manually preventing axial movement of said endless screw along said rail member, said brake member comprising a pair of brake arms at least partially surrounding the shaft of said endless screw and being movable between a non-operational and an operational position, biasing means biasing said brake arms to operational position and lever means for restraining said pair of arms in said non-operational position, said lever means being manually movable to allow said biasing to bias said pair of arms towards said operational position, said pair of arms radially clearing said endless screw shaft in said non-operational position and radially engaging said endless screw shaft in said operational position.

The invention also concerns a scaffolding comprising one rail member having a plurality of aligned, equally spaced stud members laterally protruding from said rail member, a sleeve member and a work platform secured to each other and at least partially surrounding said rail member for longitudinal movement therealong, an endless screw rotatably attached to said sleeve member and defining a peripheral helical flange, said endless screw having its rotation axis parallel to said rail member, power means for inducing a reversible rotation movement to said endless screw, said peripheral flange being destined to bear on at least two of said stud members for axial movement of said endless screw resulting from the rotation movement thereof, said power means and said endless screw being linked through the instrumentality of at least one speed reducer which will impart slower speeds to said endless screw but will allow said work platform to lift greater loads for a same power output, said sleeve member having a plurality of pairs of idle wheels rotatably mounted thereon and bearing on said rail member to guide said sleeve member therealong.

another embodiment of the invention is a scaffolding comprising at least two spaced post members each having a plurality of aligned, equally and vertically spaced stud members and a work platform installed between said two post members, a sleeve member at each end of said work platform which at least partially surrounds a related one of said post members for longitudinal movement therealong, an endless screw rotatably attached to each one of said sleeve members and defining a peripheral helical flange, each of said endless screw having its rotation axis parallel to the related post member, power means for inducing a reversible rotation movement to said endless screws, said peripheral flange bearing on at least two of said stud members for axial movement of said endless screw resulting from the rotation movement thereof.

Alternately, said scaffolding can comprise at least two work platforms and at least three post members, each of said work platforms sharing a same post member positioned between the two of them.

DETAILED DESCRIPTION OF THE EMBODIMENTS

Figure 1:
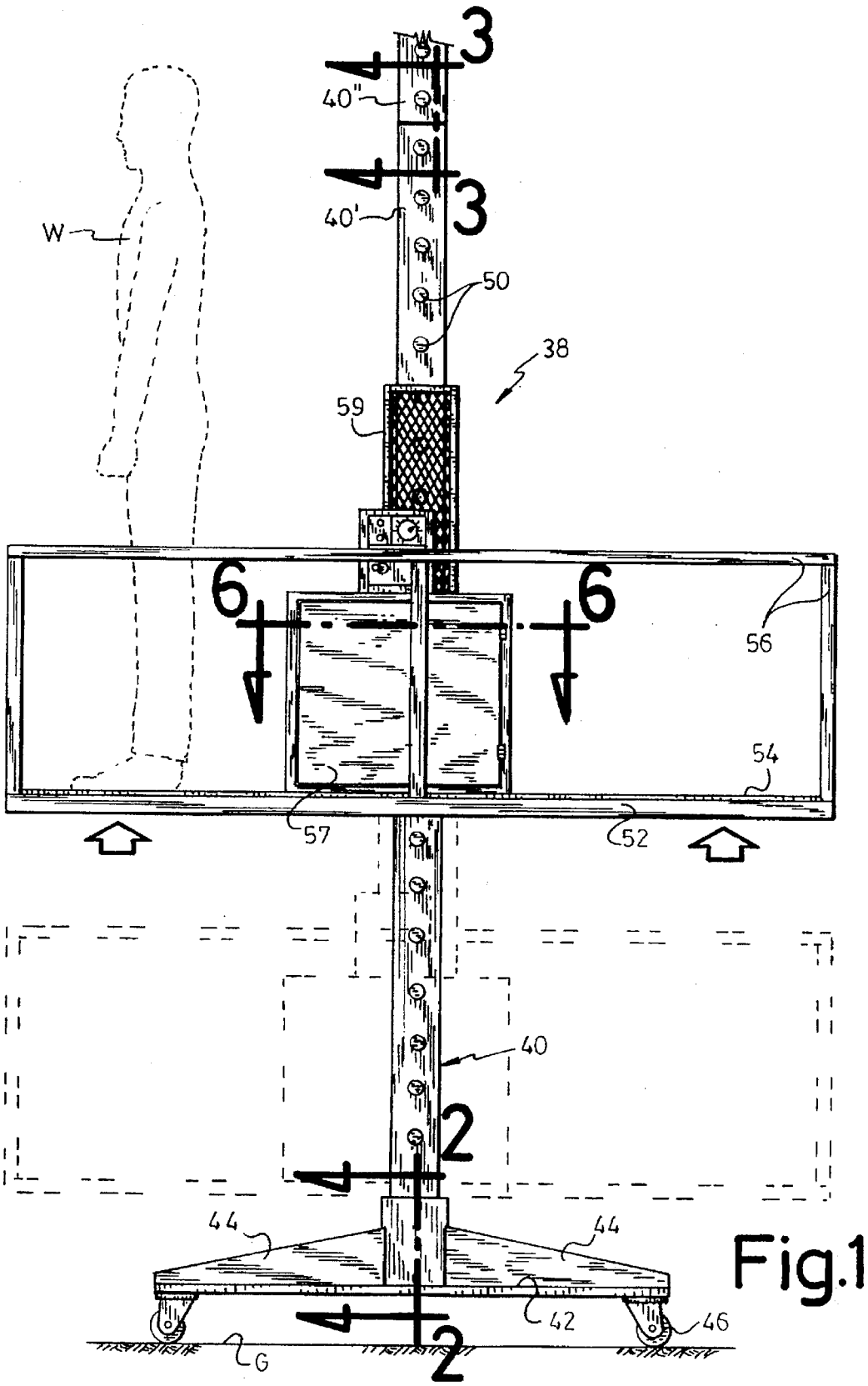
FIG. 1 is side elevation of a scaffolding equipped with the lifting apparatus of the invention, suggesting in dotted lines a user of the scaffolding.

FIG. 1 shows a first embodiment of the invention. A scaffolding 38 comprises a tower or post member 40 standing in upright position on a wide and substantially flat foot member 42. Foot member 42 comprises several radial joists 44 that confer structural resistance thereto. Foot member 42 further comprises several support wheels 46 depending from its lower surface which are rotatably attached thereto. Foot member 42 stands on support wheels 46, the latter allowing a relatively easy displacement of scaffolding 38 on ground G.

Figure 2:
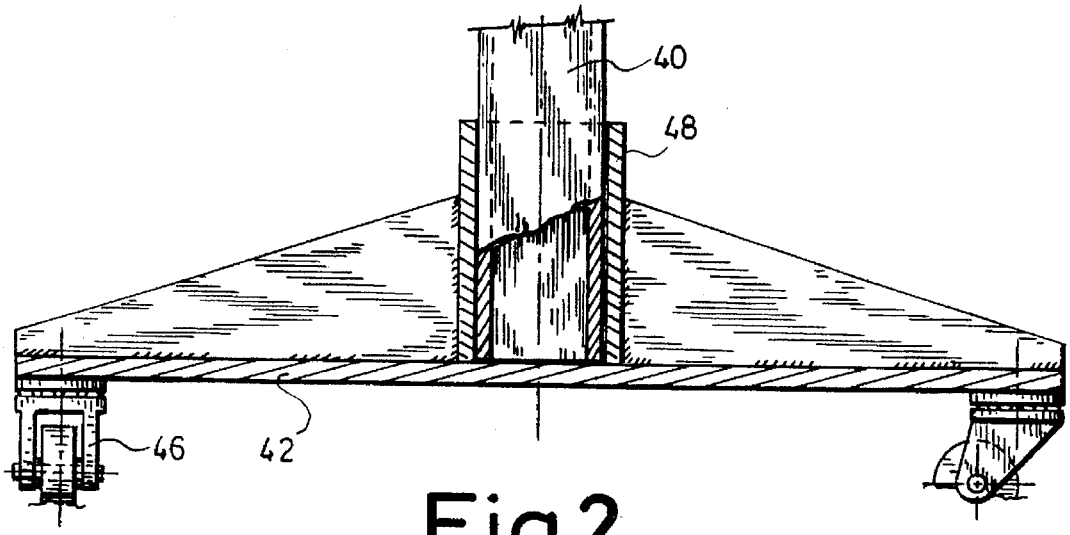
FIGS. 2 and 3 are cross-sectional views, at an enlarged scale, taken along lines 2—2 and 3—3, respectively, of FIG. 1.

FIG. 2 shows that post member 40 is removably inserted in a complementary hollow post casing 48 fixedly attached to foot member 42. It can be seen that post member 40 is hollow, to prevent excessive weight of the latter.

FIG. 1 illustrates that post member 40 has a plurality of vertically aligned and equally spaced studs 50 which protrude outwardly and horizontally from one side of post member 40. A frame 52 is vertically movable along post member 40, on which a work platform 54 rests. As suggested in dotted lines, at least one workman W can stand on work platform 54, surrounded by safety gates 56 of frame 52.

A casing 57, included in frame 52, houses the lifting apparatus of the invention. A safety screen 59 is provided over casing 57, so that no object or no human body parts will get stuck in the lifting apparatus in casing 57.

Figure 3:
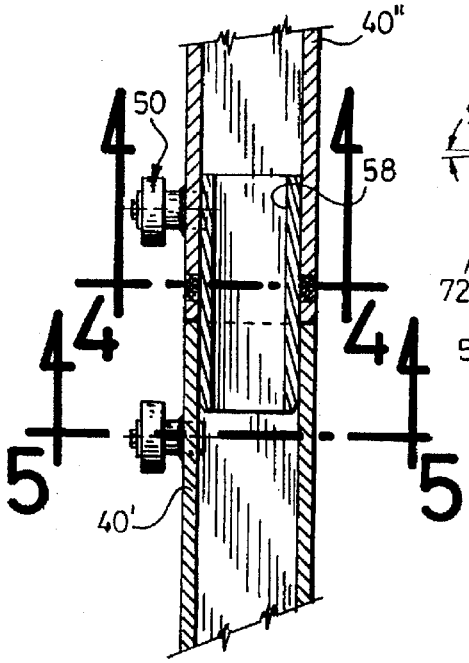
Figure 4:
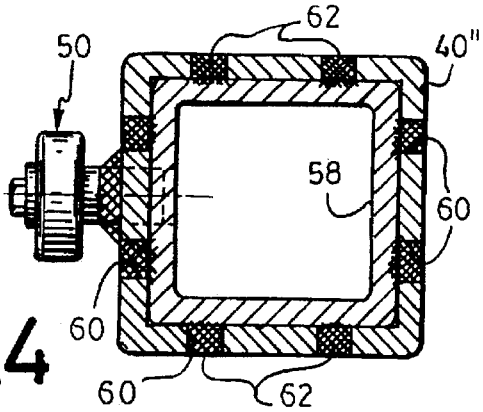
Figure 6:
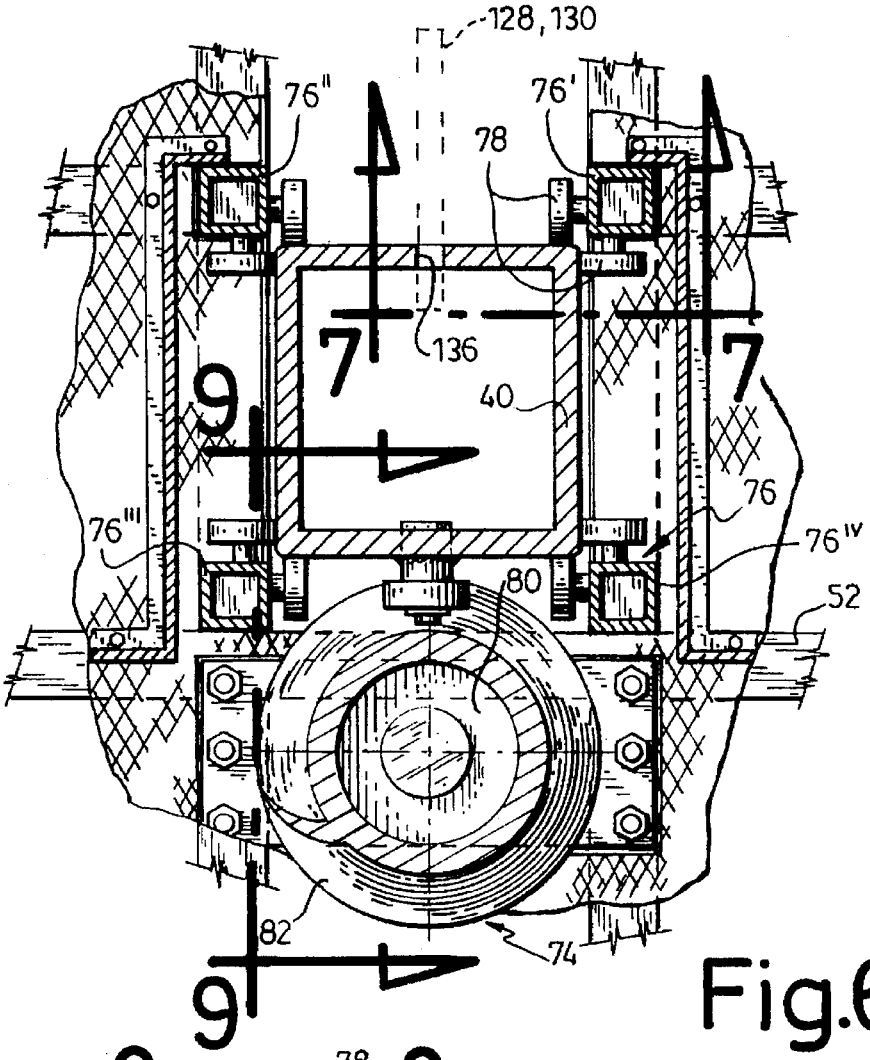
FIG. 6 is a cross-sectional view, at an enlarged scale, taken along line 6—6 of FIG. 1.

Post member 40 is composed of one or more segments that are positioned one on top of the other. FIG. 1 suggests that post member 40 has at least two segments 40' and 40". FIG. 3 shows that hollow segments 40' and 40" are linked by an short inner linking sleeve 58, the outer surface of which corresponds in shape to the inner surface of segments 40' and 40". Linking sleeve 58 extends well inside each segment 40' and 40". FIG. 4 shows that a plurality of holes 60 in upper segment 40" allow the welding of linking sleeve 58 to upper segment 40" of post member 40 by means of welding joints 62.

Figure 5:
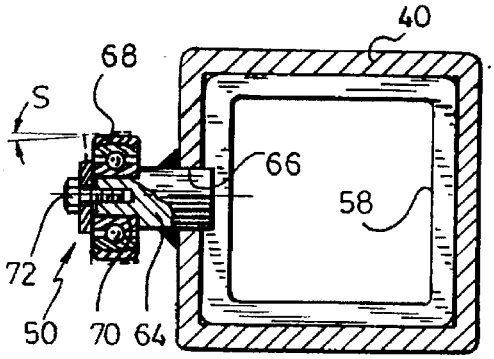
FIGS. 4 and 5 are cross-sectional views, at an enlarged scale, taken along lines 4—4 and 5—5, respectively, of FIG. 3.

FIG. 5 shows that a stud 50 comprises a short cylindrical body 64 which is inserted in a complementary bore 66 in post member 40 and fixedly anchored thereto (e.g. welded). A ball bearing 68 is installed on the periphery of stud body 64 at its extremity and abuts against an inner radial flange 70 which, together with a washer and bolt 72, prevents bearing 68 from axially sliding along stud body 64. Bearing 68 is aspheric so as to allow a small angular tangential play S to its outer ring, for reasons which will be explained later.

FIGS. 6 to 9 show a lifting apparatus 74 according to the invention. Frame 52 comprises a sleeve member 76 composed of four sleeve member rods 76', 76", 76'", $76^{iv}$, positioned on the outer periphery and near each corner of post member 40, the latter having a hollowed square cross-section. Each sleeve member post 76' to $76^{iv}$ has at least two pairs of idle wheels 78 that bear on the outer surface of post member 40 to allow sleeve member 76 to move lengthwisely therealong without any widthwise movement.

Figure 7:
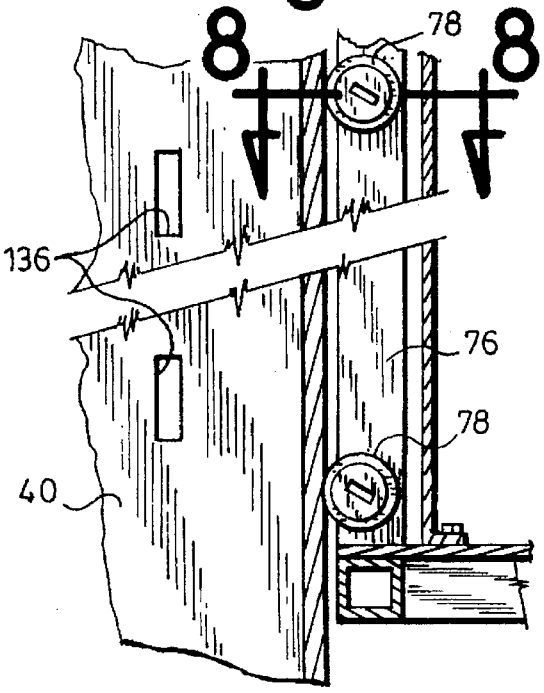
FIG. 7 is a cross-sectional view taken along line 7—7 of FIG. 6.
Figure 8:
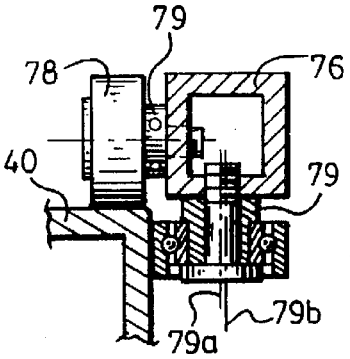
FIG. 8 is a cross-sectional view, at an enlarged scale, taken along line 8—8 of FIG. 7.

FIGS. 7 and 8 show more particularly that idle wheels 78 are formed by the outer race of ball bearings, the inner race of which surrounds an eccentric bushing 79. Rotation of bushing 79 will adjust the position of wheel 78 towards or away from post member 40, as suggested by a small axial play in FIG. 8 by a first and a second rotation axes 79*a*, 79*b*, to allow as many idle wheels 78 as possible to bear on post member 40.

An endless screw 80 is rotatably anchored at its first and second extremities 80*a*, 80*b* to complementary anchoring means 81 of sleeve member 76 and has a peripheral helical flange 82 along its intermediate portion 80*c*. Intermediate portion 80*c* has a greater diameter than extremities 80*a* and 80*b*.

Figure 9:
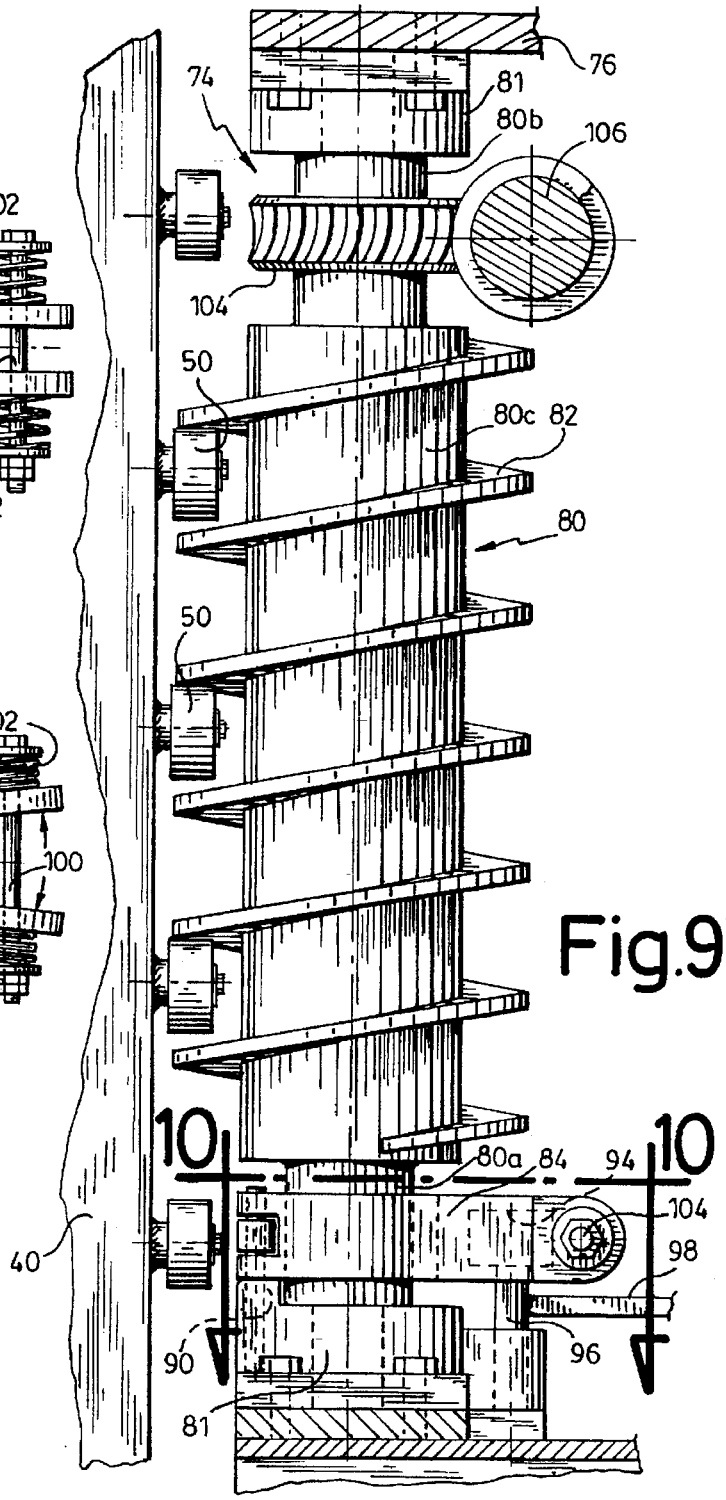
FIG. 9 is a cross-sectional view, at an enlarged scale, taken along line 9—9 of FIG. 7.

Endless screw 80 rests with its helical flange 82 on at least two studs 50, e.g. three studs as illustrated in FIG. 9, in a direction parallel to screw 80 axis. Since ball bearings 68 of studs 50 are allowed small angular axial plays, they will set themselves under the load of endless screw 80 so that the peripheral surface of ball bearings 68 will support endless screw 80 with its whole width, instead of only a single point of contact if endless screw was slightly tilted relative to studs 50. This, combined with the fact that there are three studs supporting the load of endless screw 80, spreads the load more equally over each stud than it would on the gear wheel teeth of a rack and gear assembly, thus helping to prevent early breakage of the lifting apparatus.

Figure 10:
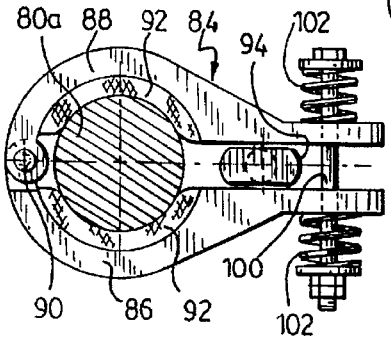
FIG. 10 is a cross-sectional view taken along line 10—10 of FIG. 9, showing the brake member of the invention in an operational position.
Figure 11:
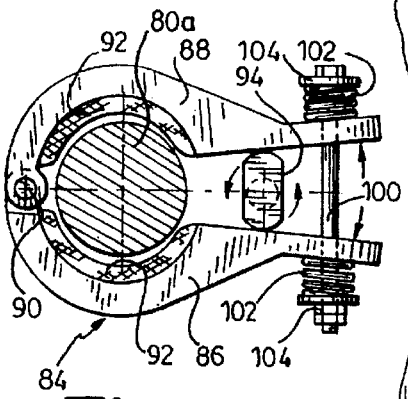
FIG. 11 is similar to FIG. 10, but the brake member of the invention is in a non-operational position.

FIGS. 9 to 11 show a manual safety brake member 84 defining a first and a second arms 86, 88 which can pivot with respect to each other through the instrumentality of a common pivot pin 90. As shown in FIG. 9, pivot pin extends into anchoring means 81 of sleeve member 76, on which first arm 86 rests. Each of first and second arms 86, 88 is generally hook-shaped, the arcuate portion thereof being equipped on its inner surface with a friction pad 92. The arcuate portions of arms 86 and 88 and their respective friction pads 92 almost completely surround peripherally first extremity 80*a* of endless screw 80. Brake member 84 can move between a non-operational position and an operational position.

In the non-operational position of brake member 84, friction pads 92 radially clear first extremity 80*a* of endless screw 80 as shown in FIG. 11. Indeed, arms 86 and 88 have straight extremities opposite their arcuate portions that are kept spaced from each other by means of an ovoidal lever member 94 fixedly linked to sleeve member by a rotatable pivot rod 96 (FIG. 9), the latter having a handle 98 for manual rotation thereof. When lever member 94 rotates to engage with its farthest ends arms 86, 88 (as suggested with arrows in FIG. 11) into a corresponding spacing position, arms 86, 88 are pivoted away from post member 40 and consequently radially clear its outer surface.

Handle 98 can be rotated to rotate in turn lever member 94 into the non-spacing position shown in FIG. 10 which corresponds to the operational position of brake member 84. A small guiding rod 100 passes through complementary transverse bores in arms 86, 88 opposite pivot pin 90, relative to endless screw 80. Two springs 102 are coaxially mounted on pivot pin 90 and each one is compressed between either one of arms 86, 88 and a nut 104. Therefore, when lever member 94 is rotated in its non-spacing position, arms 86, 88 are biased towards each other by springs 102 until friction pads 92 radially engage with their inner surface first extremity 80*a* of endless screw 80. Springs 102 apply continuous significant pressure on arms 86, 88 to provide radial pressure on endless screw 80 by means of friction pads 92, thus preventing the latter from rotational movement when manual brake member 84 is in its operational position.

There is preferably provided a security system (not shown) in the form of small metal plates vertically aligned and equally spaced on post member 40, one metal plate being positioned under each stud 50 but vertically spaced from it so as to be right under every other turn of helical flange 82 of endless screw 80 without touching it. If a stud 50 should break under the load of endless screw 80, the next turn of helical flange 82 under the broken stud 50 would bear upon such a metal plate, so that the load of endless screw 80 would not bear on only two studs 50, but on two studs 50 and one metal plate. This would allow lifting apparatus 74 to continue to operate securely without having to repare it immediately.

Figure 13:
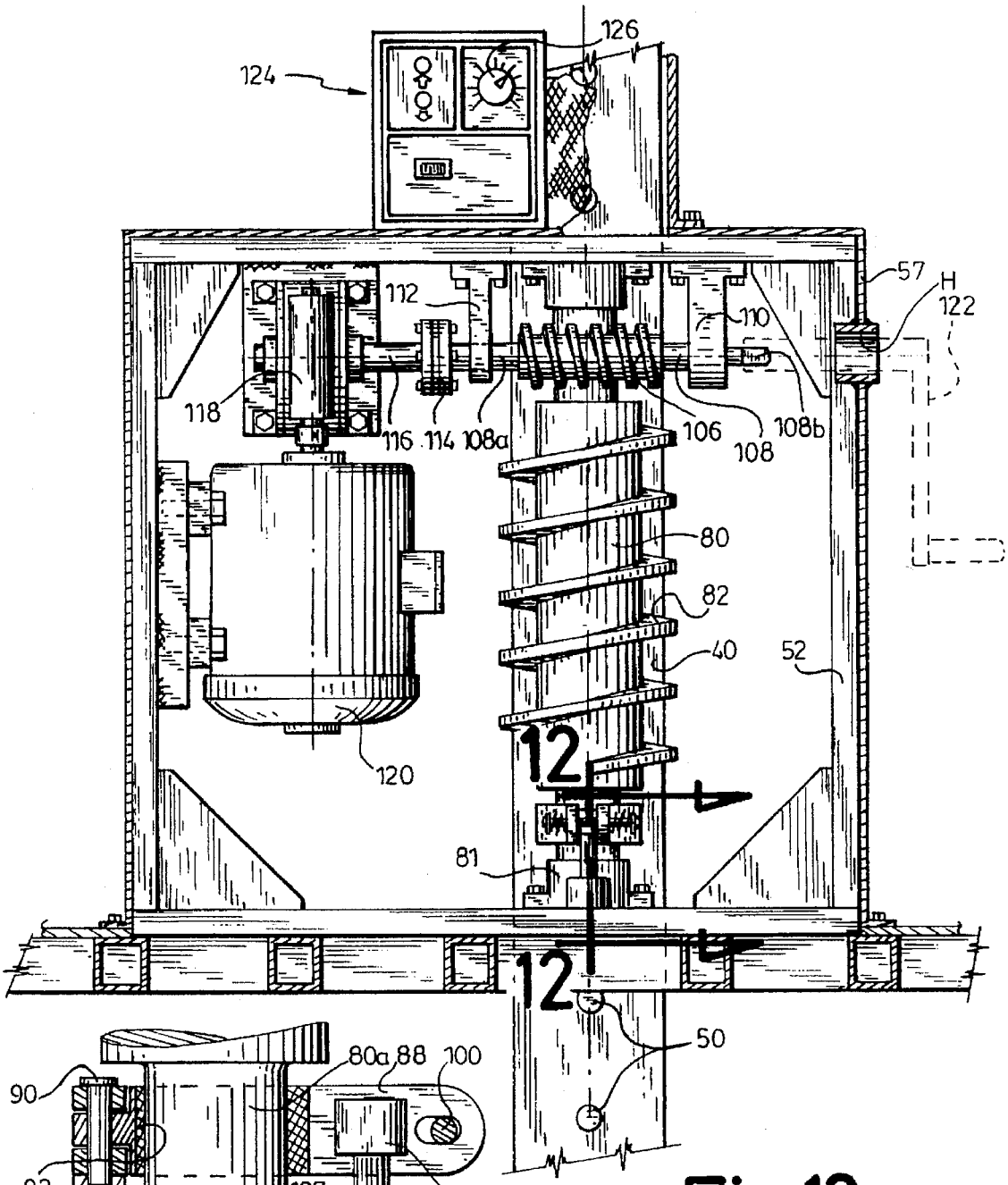
FIG. 13 is a side elevation, partly in section, of the raising apparatus of the invention.

FIGS. 9 and 13 shown that endless screw 80 has, at its second extremity 80*b*, a coaxial and integral gear wheel 104 which is engaged by a secondary endless screw 106. Due to the diameter ratios of both endless screws 80, 106 and gear wheel 104, the screws and gear wheel assembly consitutes a worm speed reducer between a first driving shaft 108, on which secondary endless screw is fixedly and coaxially mounted, and endless screw 80.

FIG. 13 shows that first driving shaft 108 is supported on one side and the other of secondary endless screw 106 by brackets 110, 112 that allow shaft 108 free rotational movement, the extremities of shaft 108 extending beyond brackets 110 and 112. Brackets 110 and 112 are fixedly attached to frame 52.

First extremity 108*a* of first driving shaft 108 is linked to a flexible coupling member 114 which in turn is linked to a second driving shaft 116. An endless screw speed reducer 118 links second driving shaft 116 to power means 120, e.g. a reversible electric motor.

When power means 120 are activated, two speed reducers 118 and 106–80 substantially reduce the output speed thereof and induce a slower rotation speed to endless screw 80 for enabling it to lift greater loads. The important speed reduction ratio is desirable also to prevent the breakage of either driving shafts 108, 116. Indeed, the important speed reduction ratio will result in a smaller induced torque in the shafts 108, 116, therefore preventing them from breaking more easily.

Flexible coupling member 114 allows a small angular axial play between frirst and second driving shafts 108 and 116.

FIG. 13 suggests that there can be provided a driving handle 122 coaxially and fixedly attached at the second extremity 108*b* of first driving shaft 108. Driving handle 122 could replace motor 120 as the power means for rotating endless screw 80. Driving handle 122 extends outside casing 57 and is supported thereon. The large speed reduction ratio allows the use of such a handle, for it is then possible to raise frame 52 with its load without access to greater power means due to the possible low speed at which this operation can be done.

A control panel 124 is provided in an accessible position outside casing 57, e.g. on top of it. Control panel 124 is connected to power means 120 and preferably comprises a rheostat starter 126 for adjusting power means 120 at the desired speed, an on-off switch and up and down switches.

Figure 12:
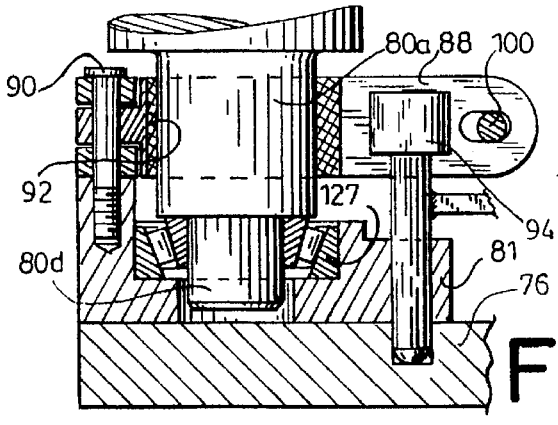
FIG. 12 is a cross-sectional view, at an enlarged scale, taken along line 12—12 of FIG. 13.

FIG. 12 shows that first extremity 80*a* of endless screw 80 has a reduced diameter end 80*d* which axially engages a thrust bearing 127 for inducing radial force as well as axial force to bearing 127, thus allowing it to roll under important axial loads without end 80*d* touching sleeve member 76.

In use, to raise (or lower) frame 52 along post member 40, power means 120 are activated to rotate endless screw 80, which engages with its helical flange 82 successive studs 50 to bear upon them. The rotation movement of flange 82 results in the axial displacement of endless screw 80, therefore raising (or lowering) lifting apparatus 74, carrying frame 52 along with it.

Since studs 50 are equipped with ball bearings 68, the friction between helical flange 82 and studs 50 is reduced to a minimum. However, the friction between helical flange 82 and the outer race of bearings 68 is most desirable to allow ball bearing 68 to roll while carrying a part of the load of screw 80, without helical flange 82 sliding on it. For small loads, flange 82 could slide on bodies 64 while using a lubricating agent.

Self-lubricated ball bearings 68 could be used, in which case lifting apparatus 74 can be used in an environment that is to be kept clean of lubricating agents.

If lifting apparatus 74 is to be used where cement is dealt with, casing 57 will protect the several endless screws from the cement, so that the latter will not lodge itself in the grooves between two successive turns of the helical flanges of the screws. Also, if cement is dropped on a stud 50, helical flange 82 will remove it when it engages the stud 50 upper surface by "cutting" its way between stud 50 and the cement.

Figure 14:
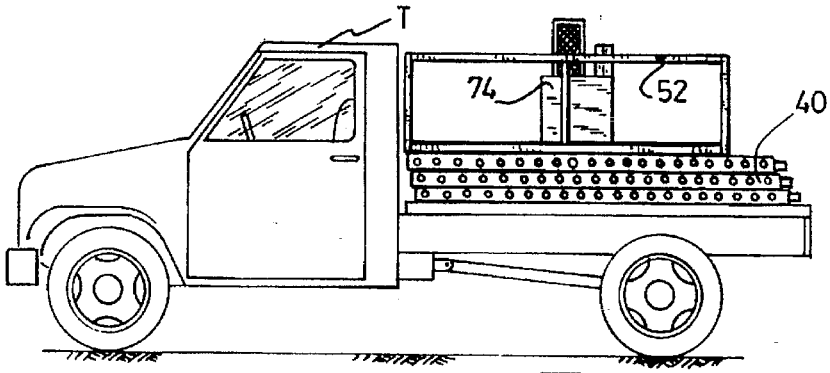
FIG. 14 is a side view of a conventional pick-up truck loaded with the scaffolding shown in dismantled, transport position.

FIG. 14 illustrates that post member 40, foot member 42, frame 52 and lifting apparatus 74 can be loaded on a pick-up-like truck T, because of the fact that its interlocking parts can easily be taken apart.

Figure 15:
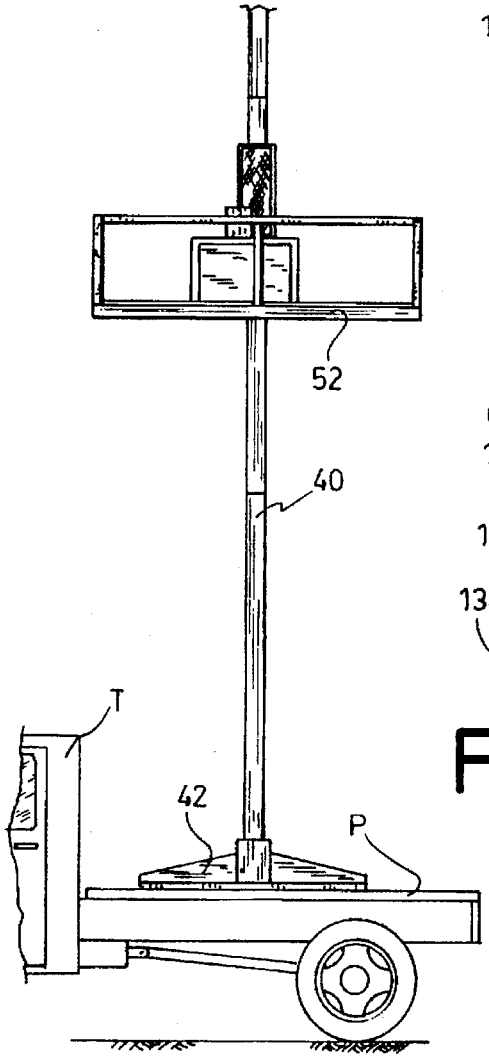
FIG. 15 is a partial side elevation of the pick-up truck of FIG. 14, the scaffolding being installed in a usable position on the pick-up truck platform.
Figure 17:
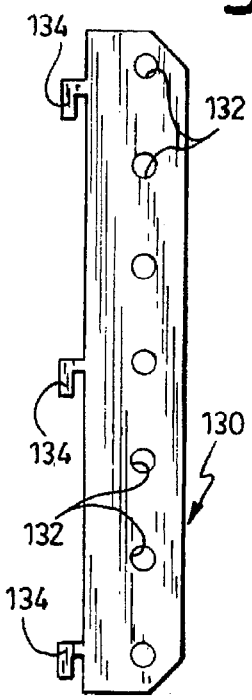
FIG. 17 is an elevation, at an enlarged scale, of the fixing member used for attaching the tower to the structure wall in FIG. 16.
Figure 16:
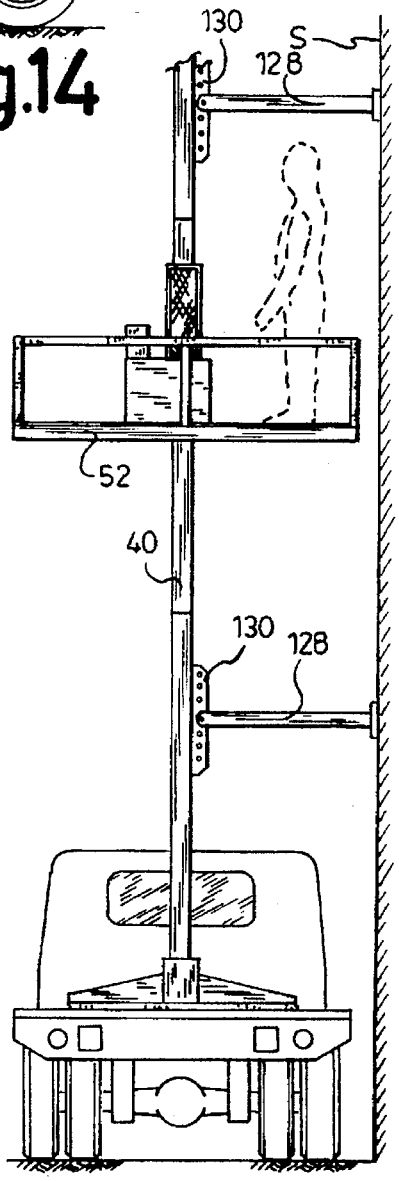
FIG. 16 is an end view of the pick up truck of figres 14 and 15, the scaffolding being installed in usable position and the scaffolding tower being attached to a structure wall.

FIG. 15 shows that foot member 42 can rest on the platform P of pick-up truck T for a stable base to scaffolding 38. FIG. 16 shows that, in such a case or whenever post member 40 is more than about fifteen feet high, it is desirable to attach post member 40 to the structure wall S, on which work is to be done, with several vertically spaced transverse fixing rods 128. Fixing rods 128 are fixed at on end to structure wall S while their other end is adjustably and removably attached to an elongated fixing member 130 which is parallel and adjacent to post member 40. Fixing member 130, shown in FIG. 17, has a plurality of through-bores 132 for adjustably attaching fixing rods 128 therein. Furthermore, fixing member 130 can be removably installed at an adjustable height on post member 40 because it has hooks 134 engageable into selected ones of a plurality of equally spaced slots 136 (shown in FIG. 7) in the wall of post member 40.

Figure 18:
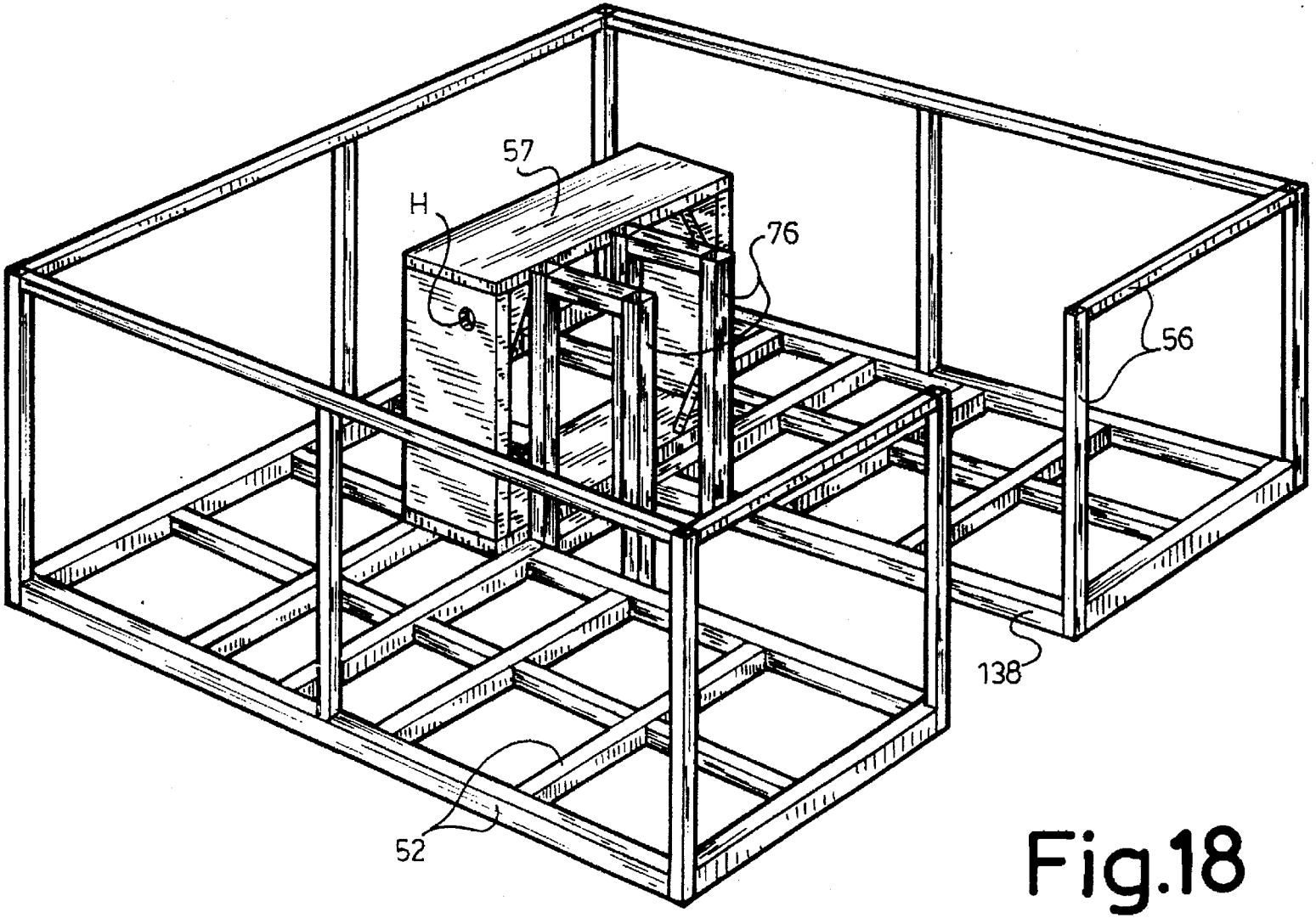
FIG. 18 is a perspective view of the frame composing the sleeve member and supporting the work platform of the invention.

FIG. 18 shows the arrangement of frame 52 equipped with safety gates 56. Near the center of frame 52 is positioned casing 57 and sleeve member 76. It can be seen that frame 52 has an opening 138 for vertical relative movement of fixing rods 128 therethrough. Opening 128, together with the corresponding opening in gates 56, can be bridged with hinged frame portions (not shown) once frame 52 is positioned at a desired height for work to be accomplished without moving work plaform 54.

Figure 20:
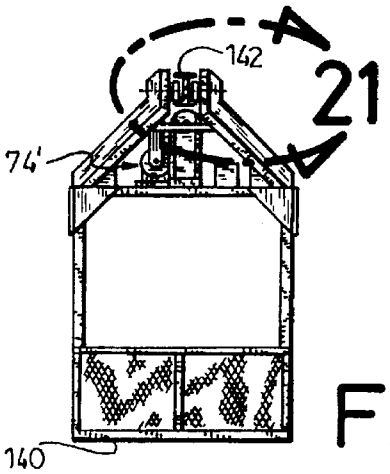
FIG. 20 is an end view of the teleferic-like housing of FIG. 19.
Figure 19:
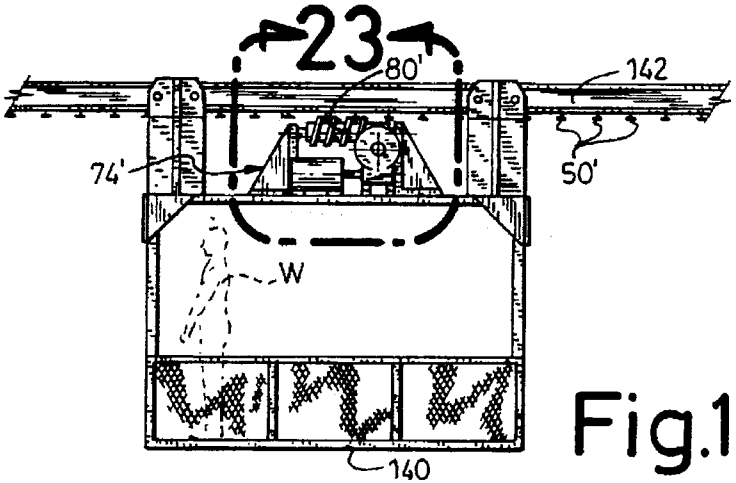
FIG. 19 is a side elevation of another embodiment of the moving apparatus of the invention used to move a teleferic-like housing along a horizontal rail.

FIGS. 19 and 20 show another application for the present invention. The moving apparatus 74' of the invention is very similar to lifting apparatus 74 mounted on scaffolding 38. A teleferic-like housing 140 for carrying at least one workman W hangs from a horizontal rail member 142 having a H-shaped cross-section and which is equipped on its lower surface with a plurality of equally-spaced, downwardly-protruding studs 50' similar to the previously-mentioned studs 50. Moving apparatus 74' is equipped with a driving endless screw 80' that engages at least two studs 50' to drive housing 140 along rail member 142 in the desired direction, the rotation movement of endless screw 80' resulting in its axial displacement.

Moving apparatus 74' is installed on top of basket 140, the upper surface of the latter being parallel to rail member 142.

Figure 21:
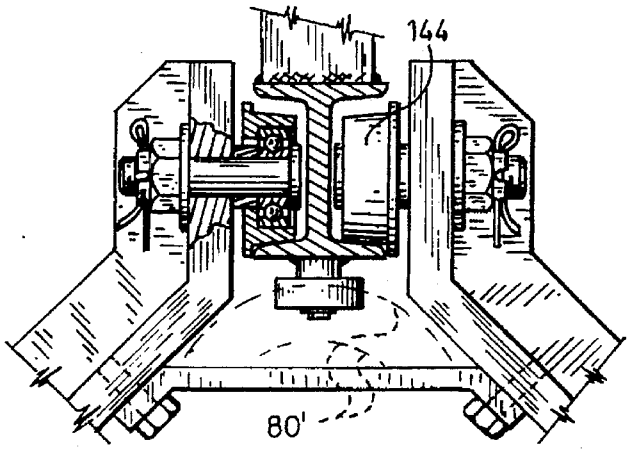
FIG. 21 is a view, at an enlarged scale, of the area circumscribed in area 21 of FIG. 20 and is also a cross-sectional view, at an enlarged scale, taken along line 21—21 of FIG. 22.

FIG. 21 shows that moving apparatus 74' comprises idle wheels 144 that engage the flanges of H-shaped rail member 142 to support housing 140.

Figure 22:
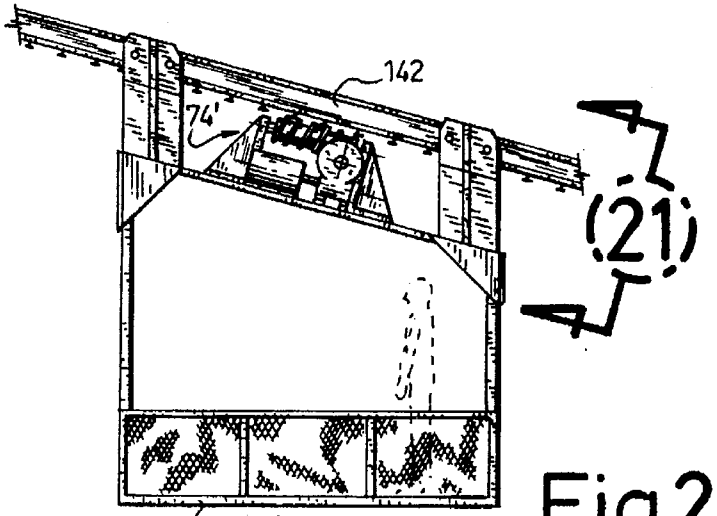
FIG. 22 is a side elevation of the raising apparatus of the invention used on an inclined teleferic-like housing.

FIG. 22 illustrates that rail member 142 can be inclined with only minor modifications to the invention, a housing 140' then being provided with an upper surface parallel to rail member 142 on the top of which moving apparatus 74' is installed.

It is understood that it would be possible to provide a housing with a hinged attachment on the housing to always keep the endless screw parallel to the rail member and the housing horizontal, so that inclined and horizontal rails may be travelled upon successively.

Figure 23:
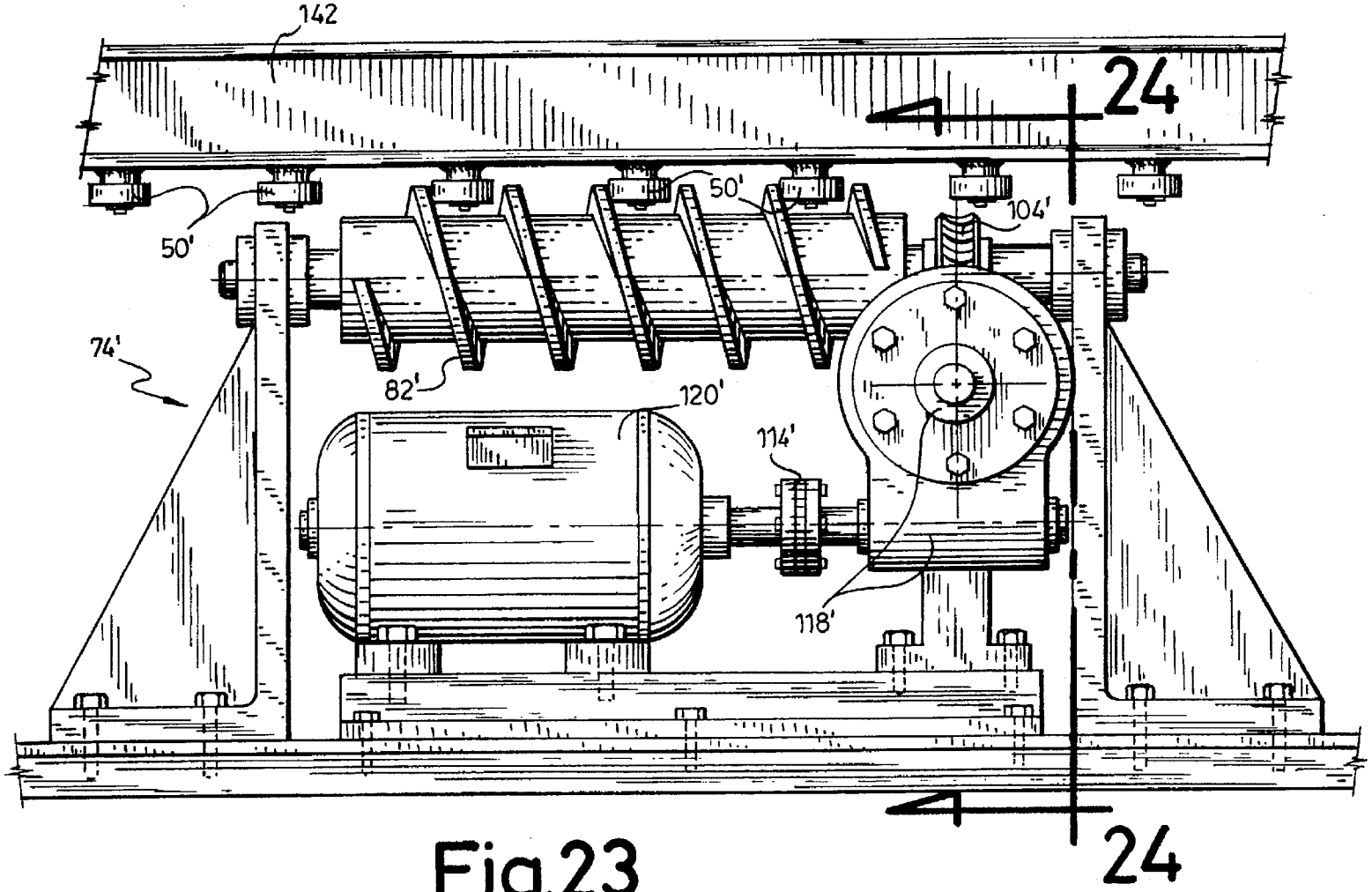
FIG. 23 is a partial end view, at an enlarged scale, taken along line 23—23 of FIG. 22.
Figure 24:
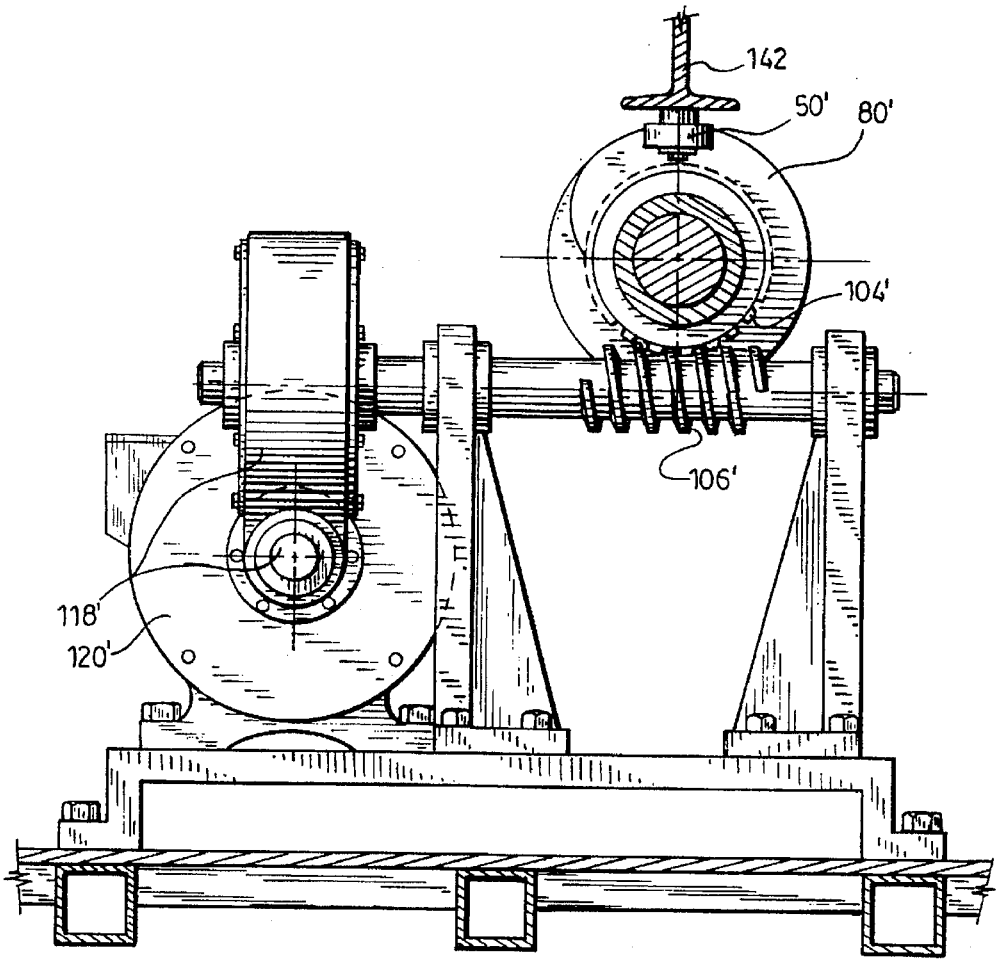
FIG. 24 is a cross-sectional view taken along line 24—24 of FIG. 23.

FIGS. 23 and 24 show the moving apparatus 74'. It can be seen that the rotation axis of endless screw 80' is arranged to be parallel to the longitudinal axis of rail member 142, as with endless screw 80 with respect to post member 40. Moving apparatus 74' again comprises power means 120' linked to a speed reducer 118', a secondary endless screw 106' and a gear wheel 104'. A flexible coupling member 114' links power means 120' to speed reducer 118'.

Moving apparatus 74' operates in a manner similar to lifting apparatus 74: power means 120' activate endless screw 80' through the instrumentality of speed reducer 118', secondary endless screw 106' and gear wheel 104'. The helical flange 82' of endless screw 80' thus rotates and bears upon each successive stud 50' for axial displacement of endless screw 80', to move moving apparatus 74' —and consequently housing 140 or 140' —along rail member 142'.

Figure 25:
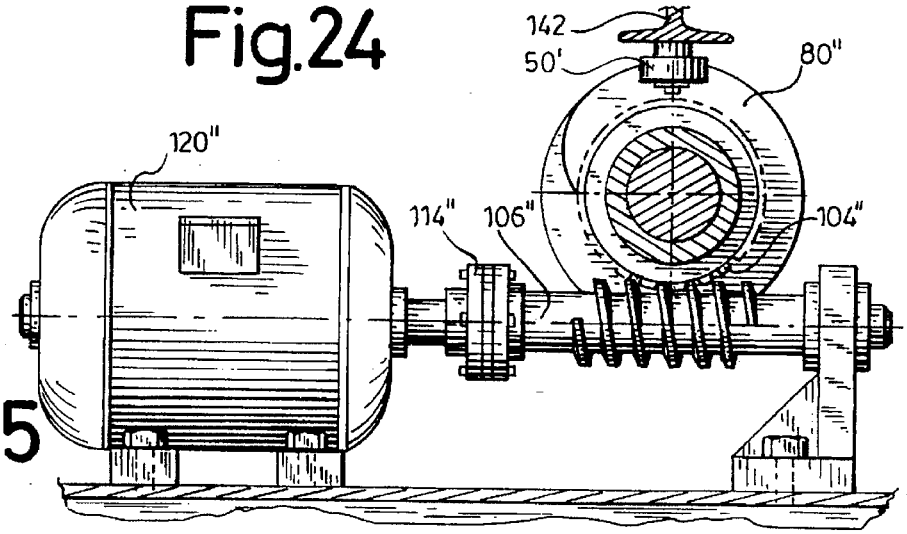
FIG. 25 is similar to FIG. 24, but the raising apparatus is now without one speed reducer.

FIG. 25 shows another embodiment of the invention wherein power means 120" are linked, through the instrumentality of a flexible coupling member 114", to a secondary endless screw 106" which engages a complementary gear wheel 104" coaxially mounted on the shaft of endless screw 80". The difference between this embodiment and the others, is that there is no speed reducer other than the one composed by secondary endless screw 106" and gear wheel 104". Otherwise, the moving apparatus operates in a similar manner as does moving apparatus 74'.

Moving apparatus 74' can be used, together with housings 140 or 140', to work on bridges or similar very long and high structures, e.g. for sand-blasting or painting such structures. The teleferic-like housing is then highly desirable, for it can easily be moved at the desired position along the length of the structure for the work to be accomplished.

Figure 26:
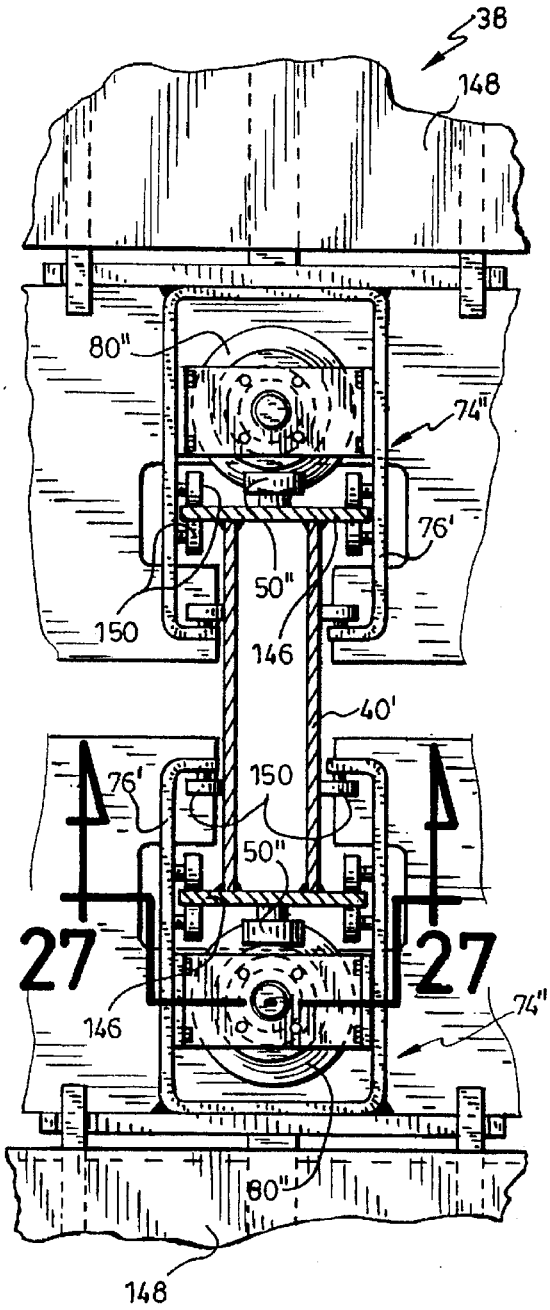
FIG. 26 is similar to FIG. 6, but the tower section is now elongated to allow two lifting apparatuses to work independently on the same tower.
Figure 27:
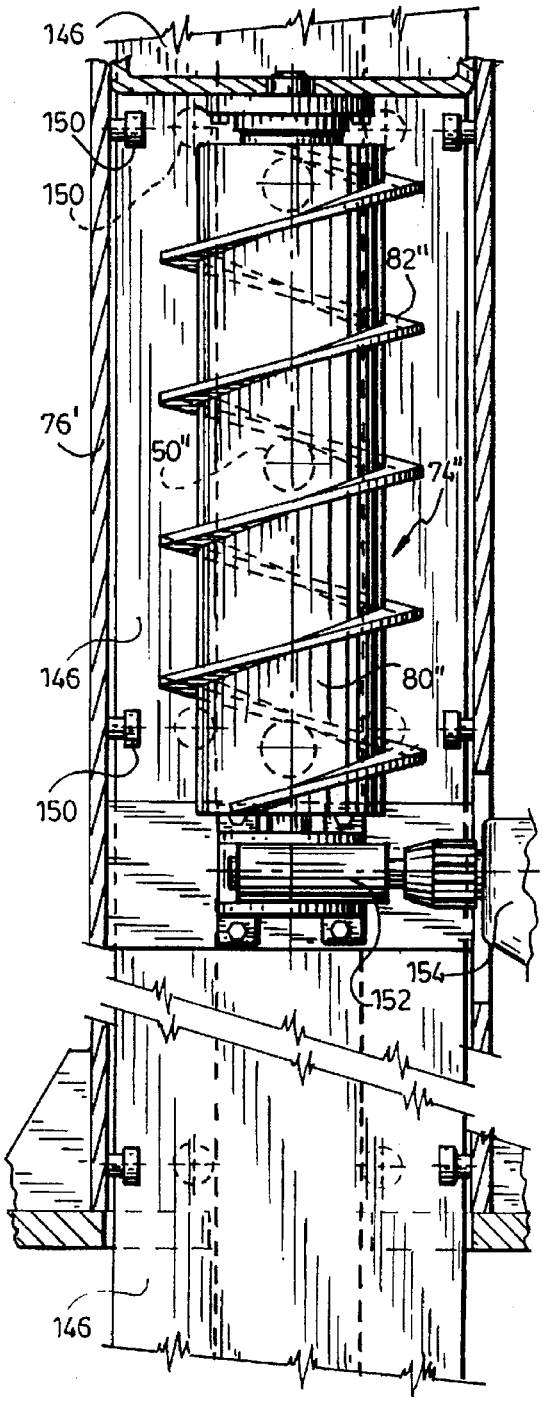
FIG. 27 is a cross-sectional view, at an enlarged scale, taken along line 27—27 of FIG. 26.

FIGS. 26 and 27 show yet another embodiment of the invention. Scaffolding 38' comprises a plurality of post members 40', each of which defines an rectangular cross-section having a pair of flanges 146 at its extremities. At least one work platform 148, e.g. two work platforms 148 in FIG. 26, compose scaffolding 38', one lifting apparatus 74" being fixedly installed at each end of each work platform 148.

Each lifting apparatus 74" comprises a sleeve member 76' having a generally U-shaped cross-section with inwardly oriented ends. At least six pairs of idle wheels 150, rotatably installed on the sleeve member 76' inner surface, peripherally bear on post member 40' to guide lifting apparatus 74" therealong, engaging flange 146 on both its sides for preventing lifting apparatus 74" from moving longitudinally along the cross-section of post member 40' and post member 40' on both its long sides for preventing lifting apparatus 74" from moving widthwisely with respect to post member 40'. Post member 40' also has a plurality of equally vertically spaced studs 50" which are similar to studs 50 and studs 50'.

An endless screw 80", similar to endless screw 80, engages with its helical flange 82" at least two successive studs 50", e.g. three studs 50" in FIG. 27, to raise (or lower) lifting apparatus 74" when it rotates.

A speed reducer 152 links endless screw 80" to power means 154. Power means 154 can be, for example, a removable conventional portable electric power drill for easy use and carrying.

In other respects, lifting apparatus 74" operates in a similar manner than lifting apparatus 74.

To raise one of the work platforms 148, the two lifting apparatuses 74" at each end of platform 148 must be activated simultaneously so that each end will be raised. Also, the two lifting apparatuses 74" can be activated alternately, each one being raised of approximately a foot at a time to prevent work platform 148 from being too inclined.

This embodiment of the invention allows two or more work platforms to work independently, with two platforms always sharing one post member between the two of them.

It is understood that all post members and rail members in the previous embodiments play a similar role, as do lifting apparatuses 74 and 74" and moving apparatus 74'.

I claim:

1. In combination, a work platform, an elongated rail member, and a moving apparatus movingly mounting said work platform along said rail member, said moving apparatus comprising a plurality of aligned, equally spaced stud members laterally protruding from said rail member, said elongated rail member defining a longitudinal axis, a sleeve member which at least partially surrounds said rail member for longitudinal movement therealong and to which is attached said work platform, an endless screw rotatably attached to said sleeve member for rotation about an axis parallel to the longitudinal axis of said rail member, said endless screw defining a peripheral helical flange, and power means for inducing a rotation movement to said endless screw, said peripheral flange bearing on at least two of said stud members for axial movement of said endless screw resulting from the rotation movement thereof; wherein said rail member is a post member and said moving apparatus is a lifting apparatus for raising said work platform along said post member.

2. A moving apparatus as defined in claim 1, wherein said helical flange of said endless screw bears on three of said stud members.

3. A moving apparatus as defined in claim 2, wherein said stud members include aspheric ball bearings allowing an angular axial play of each of said ball bearings, each ball bearing defining a peripheral surface, said play allowing said ball bearing to set itself under the load of said endless screw so that the peripheral surface of said ball bearing will support said endless screw with its whole width.

4. A moving apparatus as defined in claim 1, wherein said power means and said endless screw are linked via at least one speed reducer which will impart slower speeds to said endless screw but will allow said moving apparatus to move greater loads for a same power output.

5. A moving apparatus as defined in claim 4, wherein said power means is a reversible electric motor.

6. A moving apparatus as defined in claim 4, wherein said power means is a manual driving handle for imparting rotation movement to said endless screw.

7. A moving apparatus as defined in claim 1, wherein said sleeve member has a plurality of pairs of idle wheels rotatably mounted thereon, said idle wheels bearing on said post member and guiding said sleeve member therealong. movable to allow said biasing to bias said pair of arms towards said operational position, said pair of arms radially clearing said endless screw shaft in said non-operational position and radially engaging said endless screw shaft in said operational position.

8. A moving apparatus as defined in claim 1, further comprising a security brake member for manually preventing axial movement of said endless screw along said post member, said brake member comprising a pair of brake arms at least partially surrounding said endless screw and being movable between a non-operational and an operational position, biasing means biasing said brake arms to operational position and lever means for restraining said pair of arms in said non-operational position, said lever means being manually movable to allow said biasing means to bias said pair of arms towards said operational position, said pair of arms radially clearing said endless screw shaft in said non-operational position and radially engaging said endless screw shaft in said operational position.

9. A scaffolding comprising an upright rail member having a plurality of aligned, equally spaced stud members laterally protruding from said rail member, a sleeve member and a work platform secured to each other and at least partially surrounding said rail member for longitudinal movement therealong, an endless screw rotatably attached to said sleeve member and defining a peripheral helical flange, said endless screw having its rotation axis parallel to said rail member, power means for inducing a reversible rotation movement to said endless screw, said peripheral flange being bearing on at least two of said stud members for axial movement of said endless screw resulting from the rotation movement thereof, said power means and said endless screw being linked via at least one speed reducer which will impart slower speeds to said endless screw but will allow said work platform to lift greater loads for a same power output, said sleeve member having a plurality of pairs of idle wheels rotatably mounted thereon and bearing on said rail member to guide said sleeve member therealong.

10. A scaffolding comprising at least two spaced post members each having a plurality of aligned, equally and vertically spaced stud members and a work platform installed between said two post members, a sleeve member at each end of said work platform which at least partially surrounds a related one of said post members for longitudinal movement therealong, an endless screw rotatably attached to each one of said sleeve members and defining a peripheral helical flange, each of said endless screw having its rotation axis parallel to the related post member, power means for inducing a reversible rotation movement to said endless screws, said peripheral flange bearing on at least two of said stud members for axial movement of said endless screw resulting from the rotation movement thereof.

11. A scaffolding as defined in claim 10, comprising at least two work platforms and at least three post members, each of said work platforms sharing a same post member positioned between the two of them.

* * * * *